US005910811A

United States Patent [19]

Sato

[11] Patent Number: 5,910,811

[45] **Date of Patent: *Jun. 8, 1999**

[54] SHEET CONVEY APPARATUS

[75] Inventor: Osamu Sato, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/497,467

[22] Filed: Jun. 30, 1995

[30] Foreign Application Priority Data

Jul. 4, 1994 [JP] Japan ..... 6-152082
Jun. 13, 1995 [JP] Japan ..... 7-146237

[51] Int. Cl.[6] ..... B41J 2/01

[52] U.S. Cl. ..... 347/104

[58] Field of Search ..... 347/101, 104, 347/107; 346/134; 271/10.04, 10.05, 10.11, 105, 266, 270

[56] References Cited

U.S. PATENT DOCUMENTS 5,133,616 7/1992 Oyaide et al. ..... 400/635
5,177,547 1/1993 Kanemitsu et al. ..... 399/397
5,261,754 11/1993 Sugiura .
5,602,571 2/1997 Suda et al. ..... 346/134
5,620,174 4/1997 Taniguro et al. ..... 271/10.12

FOREIGN PATENT DOCUMENTS 0397090 11/1990 European Pat. Off. .
0478300 4/1992 European Pat. Off. .

*Primary Examiner*—Matthew Nguyen
*Attorney, Agent, or Firm*—Fitzpatrick, Cella, Harper & Scinto

[57] ABSTRACT

The present invention provides a sheet convey apparatus with a first convey unit for pinching and conveying a sheet, and a second convey unit disposed at a downstream side of the first convey unit and adapted to pinch and convey the sheet. When elongation of the sheet generated between the first and second convey units is t, a convey amount of the first convey unit is L1 and a convey amount of the second convey unit is L2, a relation of L2≧L1+t is satisfied. The present invention further provides an image forming apparatus using such a sheet convey apparatus.

30 Claims, 10 Drawing Sheets

FIG. 12

| | METHOD (1) | | METHOD (2) | | METHOD (3) | | METHOD (4) | |
|---|---|---|---|---|---|---|---|---|
| DRIVE SYSTEM | INDEPENDENT DRIVEN | | DOWNSTREAM SPEED CHANGED | | BOTH ROLLERS FOLLOWED | | BOTH ROLLERS FOLLOWED | |
| DRIVE SOURCE | PLURAL | | SINGLE | | SINGLE | | SINGLE | |
| SPEED CHANGE MECHANISM | NO | | EXIST | | NO | | NO | |
| | CONVEY AMOUNT | | CONVEY AMOUNT | | CONVEY AMOUNT | | CONVEY AMOUNT | |
| RECORDING SHEET POSITION | UP-STREAM | DOWN-STREAM | UP-STREAM | DOWN-STREAM | UP-STREAM | DOWN-STREAM | UP-STREAM | DOWN-STREAM |
| STATE (A) | $L_1$ | $L_2$ | $L_1$ | $L_2$ | $L_1$ | $L_2$ | $L_1$ | $L_2$ |
| STATE (B) | $L_1$ | $L_1$ | $L_1$ | $L_1$ | $L_1$ | $L_2$ | $L_1 \times L_1 / L_2$ | $L_1$ |
| STATE (C) | $L_1$ | $L_1$ | $L_1$ | $L_1$ | $L_1 \times L_1 / L_2$ | $L_1$ | $L_1 \times L_1 / L_2$ | $L_1$ |

STATE (A): UPSTREAM AND DOWNSTREAM ROLLERS NIP RECORDING SHEET

STATE (B): TRAIL END OF RECORDING SHEET PASS THROUGH NIP PORTION OF UPSTREAM ROLLER

STATE (C): ONLY DOWNSTREAM ROLLER NIPS RECORDING SHEET

SHEET CONVEY APPARATUS

BACKGROUND OF THE INVENTION

1. Field of the Invention

The present invention relates to a sheet convey apparatus suitable for use with an image forming apparatus such as an ink jet recording apparatus wherein an image is formed by scanning a recording head in serial manner.

2. Related Background Art

In the past, various recording apparatuses having various image forming means have been put to practical use. Among them, ink jet recording apparatuses and thermal transfer recording apparatuses have a low manufacturing cost and are less noisy and have been widely used from personal use to office use. In image forming apparatuses of the ink jet type and thermal transfer type, generally, an image is formed by shifting to a recording sheet relative to a recording portion of the apparatus. In printers of serial scan type using the ink jet recording method, the recording sheet is intermittently shifted by a predetermined width and a portion of the image is formed on the width of the recording sheet which was shifted. Further, the recording sheet is generally conveyed by means of convey rollers disposed at upstream and downstream sides of the recording portion. In order to reduce the margin in the recording sheet, a tip end or front portion of the recording sheet in a condition that the recording sheet is pinched only between the convey rollers disposed at the upstream side of the recording portion, an intermediate or middle portion of the recording sheet in a condition that the recording sheet is pinched between both the convey rollers disposed at the upstream and downstream sides of the recording portion, and a trail end or rear portion of the recording sheet in a condition that the recording sheet is pinched only between the convey rollers disposed at the downstream side of the recording portion.

In the ink jet recording apparatuses, elongation of the recording sheet occurs at the recording portion due to ink. Thus, even when the recording sheet is conveyed by the cooperation of the upstream and downstream convey rollers, in order to convey the recording sheet accurately, a convey amount of the recording sheet must be controlled by the upstream convey rollers. Accordingly, when the recording sheet is between both the upstream and downstream convey rollers, by setting a recording sheet pinching pressure (P1) of the upstream rollers to become greater than a recording sheet pinching pressure (P2) of the downstream rollers, the conveying amount is regulated by the convey rollers disposed at the upstream of the recording portion, and, by setting the sheet convey amount (L2) of the downstream convey rollers to become greater than the sheet convey amount(L1) of the upstream convey rollers, the recording sheet is conveyed while slipping the downstream rollers, thereby preventing the looseness of the recording sheet at the recording portion.

In FIG. 11 which is a sectional view showing a main portion of a conventional recording portion, a convey roller 1 is disposed at an upstream side of the recording portion, and a driven roller 3 serves to bias a recording sheet 9 against the convey roller 1. Similarly, a sheet discharge roller 2 is disposed at a downstream side of the recording portion, and a driven roller 4 serves to bias the recording sheet 9 against the sheet discharge roller 2.

In this example, a ratio between a biasing force of the driven roller 3 associated with the convey roller and a biasing force of the driven roller 4 associated with the sheet discharge roller 2 is about 4:1. With this arrangement, even in the condition that the recording sheet 9 is pinched by both the rollers 1 and 2, the convey amount of the recording sheet 9 is governed by the convey roller 1. Further, although the convey amount of the sheet discharge roller 2 is set to be greater than the convey amount of the convey roller 1, since the pinching pressure of the sheet discharge roller is smaller than that of the convey roller, the recording sheet 9 is conveyed while being slipped, thereby preventing the floating and looseness of the recording sheet from occurring at the recording portion. Incidentally, in the condition that the recording sheet 9 is pinched only by one of the convey roller and the sheet discharge roller, the convey amount of the recording sheet 9 depends upon the associated roller.

In FIG. 11, the reference numeral 11 denotes a platen for supporting the recording sheet; and 13 denotes an ink jet recording head mounted on a carriage 14. Further, in FIG. 11, the recording sheet is shifted from right to left, and there are the following relations P1>P2 and L2>L1.

With the arrangement as mentioned above, when the recording sheet is conveyed, since the convey amount is determined by the upstream side convey roller 1 regarding the front and middle portions of the recording sheet, there is no problem. However, immediately after the trail end of the recording sheet leaves a nip between the upstream pair of rollers 1, 3, the convey amount of the recording sheet is governed by the sheet discharge roller 2 disposed at the downstream side of the recording portion. By the way, as mentioned above, since the convey amount of the downstream pair of rollers 2, 4 is greater than that of the upstream pair of rollers 1, 3, after the trail end of the recording sheet leaves the nip between the upstream pair of rollers, the convey amount of the recording sheet is increased, with the result that image portions are not contiguous with each other, thereby greatly deteriorating the image quality.

To avoid such a drawback, the following -trials have been proposed.

(1) The upstream and downstream convey rollers have different drive sources, the downstream convey amount L2 is kept to be greater than the upstream convey amount L1 until the trail end of the recording sheet leaves the upstream rollers, and, after the rotation of the rollers by which the trail end of the recording sheet passes through the nip between the upstream rollers, the downstream convey amount L2 is changed to L1;

(2) Although the upstream and downstream convey rollers have a common drive source, the downstream rollers have a speed change mechanism, and the downstream convey amount L2 is kept to be greater than the upstream convey amount L1 until the trail end of the recording sheet leaves the upstream rollers, and, after the rotation of the rollers by which the trail end of the recording sheet passes through the nip between the upstream rollers, the downstream convey amount L2 is changed to L1;

(3) Although the upstream and downstream convey rollers have a common drive source, there is no speed change mechanism, and the downstream convey amount L2 is kept to be greater than the upstream convey amount L1 till the rotation of the rollers by which the trail end of the recording sheet passes through the nip between the upstream rollers, and, after the trail end of the recording sheet leaves the upstream rollers, the downstream convey amount L2 is changed to L1 (in this case, the upstream convey amount becomes L1×L1/L2); and (4) Although the upstream and downstream convey rollers have a common drive source, there is no speed change mechanism, and the downstream convey amount L2 is kept greater than the upstream convey amount LI until the trail end of the recording sheet leaves the upstream rollers, and, after the rotation of the rollers by which the trail end of the recording sheet passes through the nip between the upstream rollers is reached, the downstream convey amount L2 is changed to L1 (in this case, the upstream convey amount becomes L1×L1/L2).

The above methods (1) to (4) are shown in FIG. 12 collectively.

Among the above methods, in the methods (1), (2) and (4), since the downstream convey amount is decreased to L1 (<L2) when the recording sheet passes through the nip between the upstream rollers, the looseness or slack in the recording sheet generated due to the elongation of the sheet at the recording portion cannot be eliminated. For example, when it is assumed that the recording width X at the recording portion in a sheet convey direction is 16.256 mm and a rate k of elongation of the sheet for each recording width is 0.01, the elongation of each recording width of the sheet becomes 0.16256 mm (=16.256×0.01).

If the elongation of the recording sheet is generated uniformly in the front-and-rear direction of the recording portion, even when the convey amount is correct, the end position of the recording width of the sheet will be deviated from the end of the recording portion by 0.08128 mm (=0.16256/2) in the upstream direction. This deviation amount exceeds a distance of 0.0635 mm between ink jet nozzles having 400 DPI pitch, with the result that the extended recording width overlaps with a next recording width, thereby generating a high density stripe.

On the other hand, even if the elongation of the recording sheet is not generated uniformly in the front-and-rear direction of the recording portion, the recording sheet will be floating at the recording portion, which results in contact between the recording sheet and the recording head, and wrinkles in the sheet due to the fact that the floating sheet is pinched between the downstream rollers.

Further, in the above method (3), although the downstream convey amount is maintained to L2 (>L1) when the trail end of the recording sheet leaves the nip between the upstream rollers, upon starting the rotation of the rollers by which the trail end of the recording sheet passes through the nip between the upstream rollers, if a distance c between the nip of the upstream rollers and the trail end of the recording sheet is almost zero, since the trail end of the recording sheet leaves the nip between the upstream rollers immediately, the downstream rollers cannot compensate for all of the elongation of the recording sheet at the recording portion.

For example, when the rate k of elongation of the sheet for each recording width is 0.01, as mentioned above, the elongation of each recording width of the sheet becomes 0.16256 mm. In order to eliminate the slack in the sheet by pulling the elongation of the sheet by means of the downstream rollers, the convey amount of the downstream rollers must be set to 16.4186 mm (=16.256+0.16256) or more.

In this case, however, during the recording immediately before the trail end of the recording sheet leaves the nip between the upstream rollers, when the distance c between the trail end of the recording sheet and the nip of the upstream rollers is 5 mm, since only the distance c contributes to the pulling operation of the downstream rollers, the slack in the sheet cannot be removed only by the elongation of 0.05 mm (=0.16256×c/X). Thus, the remaining elongation of 0.11256 mm (=0.16256−0.05) cannot be eliminated. Also in this case, the extended recording width overlaps with the next recording width, thereby generating the high density stripe.

As mentioned above, when the convey amount is changed from the predetermined value, if the convey amount is insufficient, the recording width which was previously recorded is partially overlapped with the next recording width which is to be recorded, thereby generating the high density stripe in the image. Further, in dependence upon the distance c between the trail end of the recording sheet and the nip of the upstream rollers, the elongation of the sheet cannot be completely eliminated even when the convey amount of the downstream rollers is not decreased (i.e. maintained to L2), thereby also generating the high density stripe.

SUMMARY OF THE INVENTION

The present invention aims to eliminate the above-mentioned conventional drawbacks, and an object of the present invention is to prevent a sheet from floating and/or jamming due to elongation and slack of the sheet generated between first and second convey means, and to prevent the formation of high density stripes when applied to an image forming apparatus.

To achieve the above object, according to the present invention, there is provided a sheet convey apparatus comprising a first convey means for pinching and conveying a sheet, and a second convey means disposed at a downstream side of the first convey means and adapted to pinch and convey the sheet. Defining elongation of the sheet generated between the first and second convey means is t, a convey amount of the first convey means is L1 and a convey amount of the second convey means is L2, a relation of L2≧L1+t is satisfied.

Further, when a trail end of the sheet leaves the first convey means on the way of conveyance, the second convey means conveys the sheet greater than the first convey means by the amount t until the trail end of the sheet leaves the first convey means from the start of the conveyance.

By adding to the sheet convey apparatus an image forming means disposed between the first and second convey means and adapted to form an image having a sheet conveying direction length X on the sheet, an image forming apparatus can be obtained.

BRIEF DESCRIPTION OF THE DRAWINGS

FIG. 12 is a view showing control effected when a trail end portion of a sheet is recorded by the conventional image forming apparatus.

DETAILED DESCRIPTION OF THE PREFERRED EMBODIMENTS

Figure 1:
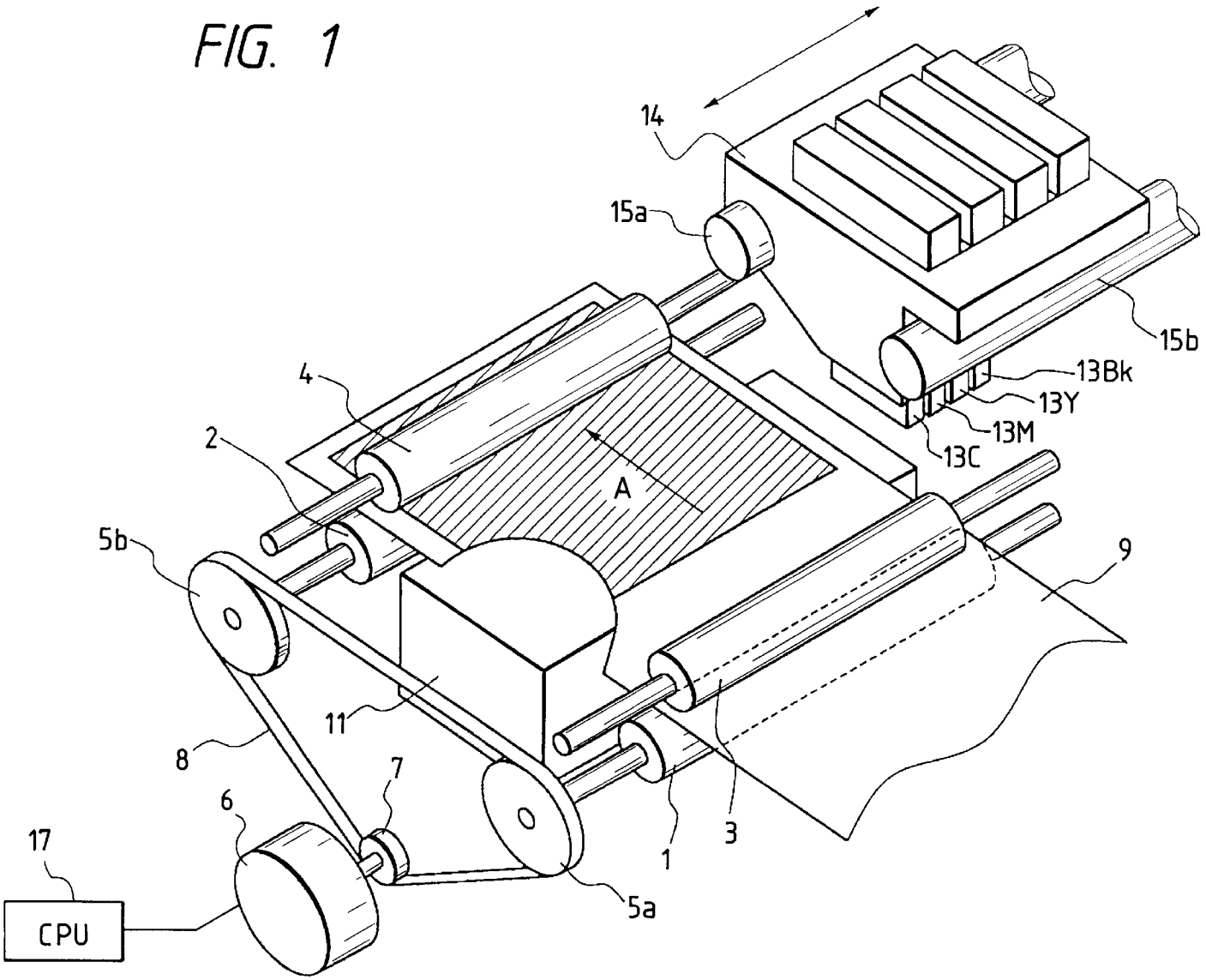
FIG. 1 is a perspective view of a recording portion of an image forming apparatus according to a preferred embodiment of the present invention.
Figure 2:
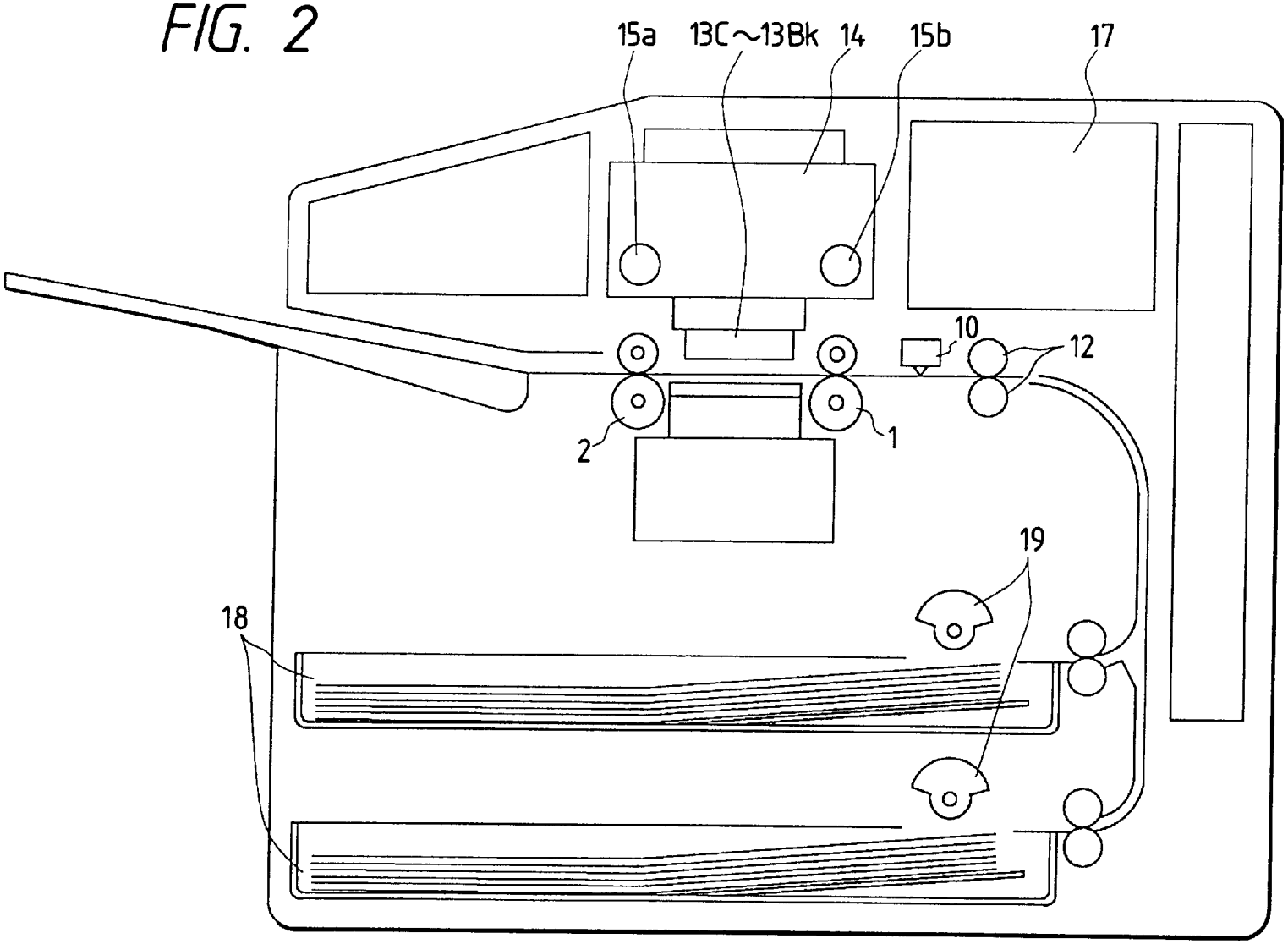
FIG. 2 is an elevational sectional view of the image forming apparatus of FIG. 1.

FIG. 1 is a perspective view of a recording portion of an ink jet recording apparatus to which the present invention is applied, and FIG. 2 is a sectional view of the ink jet recording apparatus of FIG. 1.

In FIG. 1, a convey roller 1 is disposed at an upstream side of the recording portion, and a driven roller 3 serves to bias a recording sheet 9 against the convey roller 1. Similarly, a sheet discharge roller 2 is disposed at a downstream side of the recording portion, and a driven roller 4 serves to bias the recording sheet 9 against the sheet discharge roller 2.

In this embodiment, a ratio between a biasing force of the driven roller 3 associated with the convey roller and a biasing force of the driven roller 4 associated with the sheet discharge roller 2 is about 4:1. With this arrangement, even in a condition that the recording sheet 9 is pinched by both the rollers 1 and 2, an actual convey amount (convey distance) of the recording sheet 9 is governed by the convey roller 1. Further, although a convey amount of the sheet discharge roller 2 is set to be greater than the convey amount of the convey roller 1, since a pinching pressure of the sheet discharge roller is smaller than that of the convey roller, the recording sheet 9 is conveyed while being slipped, thereby preventing the floating and looseness of the recording sheet from occurring at the recording portion. Incidentally, in a condition that the recording sheet 9 is pinched only by one of the convey roller and the sheet discharge roller, the convey amount of the recording sheet 9 depends upon the associated roller.

The convey roller 1 and the sheet discharge roller 2 are provided at their one ends with pulleys 5*a*, 5*b* fitted thereto, respectively, so that the rollers are driven by a pulse motor 6 through a motor pulley 7, a transmission belt 8 and the pulleys 5*a*, 5*b*. The pulse motor 6 used in this embodiment is a stepping motor having a base step angle of 0.36° and is driven by a motor driver (not shown) in a half-step manner (0.18°/step). The number of pulse supplied for each conveyance is 2000. Incidentally, a ratio between the number of teeth formed on the pulleys 5*a*, 5*b* fitted into one ends of the rollers 1, 2 and the number of teeth formed on the motor pulley 7 is set to 3:1, so that a convey direction length (recording width) for one line corresponds to ⅓ of a peripheral length of the convey roller 1.

A platen 11 serves to support the recording sheet at the recording portion. In this embodiment, in order to obtain a full-color image, a recording head unit 13 of ink jet type is constituted by a cyan recording head 13C, a magenta recording head 13M, an yellow recording head 13Y and a black recording head 13Bk which are disposed side by side in a scan direction of the recording head unit. Each recording head is provided with 256 nozzles arranged in a line with a 400 DPI pitch (where a distance between two adjacent nozzles is 0.0635 mm) to discharge ink. The recording head unit 13 mounted on a carriage 14 and is shifted or scanned along guide rails 15*a*, 15*b* in a direction shown by the arrow B so that the convey direction length (recording width) of 16.256 mm is recorded on the recording sheet as one line. Whenever the one line recording is finished, the recording sheet 9 is conveyed in a direction shown by the arrow A by a distance corresponding to the recording width. By repeating the above-mentioned operations, an image is formed on the recording sheet 9.

The carriage 14 is driven by a pulse motor (not shown) through a drive belt 16. A CPU (control means) shown in FIG. 2 serves to control the operations of the pulse motor 6, carriage driving pulse motor, recording head unit 13 and the like.

With the arrangement as mentioned above, since one-third (⅓) of the peripheral length of the convey roller 1 becomes 16.256 mm, a diameter D1 of the convey roller 1 can be determined (D1=15.523 mm). Further, the convey amount L1P of the convey roller 1 for each motor drive pulse becomes 0.008128 mm (=16.256/2000).

Figure 3:
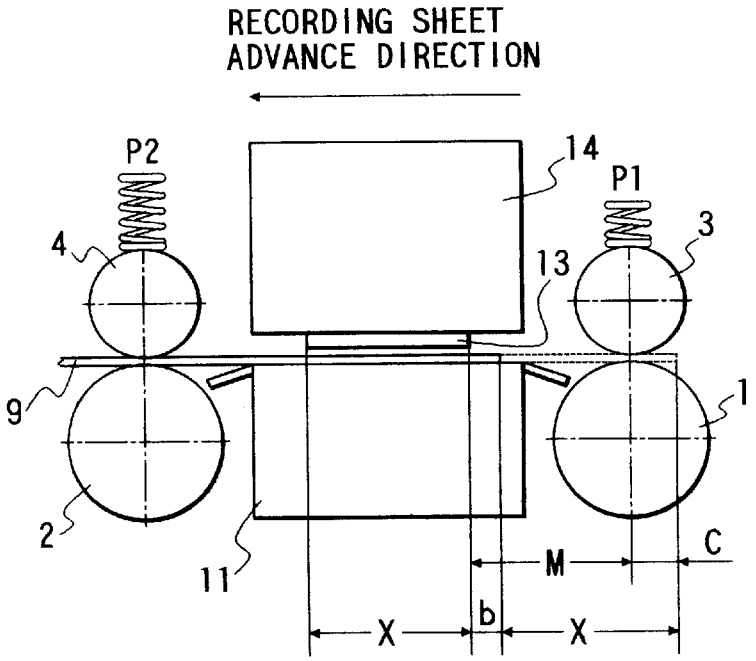
FIG. 3 is a view showing a positional condition of the recording portion of the image forming apparatus.

FIG. 3 shows a dimensional relation between various elements of the recording portion of the ink jet recording apparatus in a sectional plane.

When this apparatus is used to perform the recording, a margin generated at a lead end (tip end) portion of the recording sheet 9 has a length a and a margin generated at a trail end portion of the recording sheet 9 has a length b, regardless of a size of the recording sheet. Incidentally, regarding the trail end margin, there are some errors as mentioned hereinbelow. A distance between a recording sheet nip of the convey roller 1 and an upstream end of the recording area is set to M.

Incidentally, in the illustrated embodiment, concrete numerical values are as follows:

That is to say, X=16, 256, L=297, a=5, B=5 and M=15. Further, a distance e between the nozzles is 0.0635 mm.

Hereinbelow, the concrete values in this embodiment are shown in a bracket [ ].

The size of the recording sheet 9 is previously detected by a sensor means (not shown) or determined by an operator's input. When the entire length of the recording sheet 9 is L and the recording width is X, the actual area to be recorded becomes as follows:

$$L-a-b[=287\text{ mm}] \tag{1}$$

The recording number N effected with the recording width X becomes as follows:

$$N=INT\{(L-a-b)/X\}[=17\text{ mm}] \tag{2}$$

An area (remaining recordable area) J1 which cannot be recorded with the width X but is to be recorded becomes as follows:

$$J1=(L-a-b)-N\times X[=10.648\text{ mm}] \tag{3}$$

Since the distance between the nozzles of the recording head unit is e, a remaining recordable are J which can actually be recorded becomes as follows:

$$J=INT(J1/e+0.5)\times e[=10.668\text{ mm}] \tag{4}$$

Now, a difference between the value J and the value J1 is included in the margin at the trail end portion of the sheet. That is to say, the actual margin d at the trail end portion of the sheet: becomes as follows:

$$d=b+J1-J[=4.98\text{ mm}] \tag{5}$$

And, in this case, the following equation is satisfied:

$$L=a+J+N\times X+d \quad (6)$$

Figure 5:
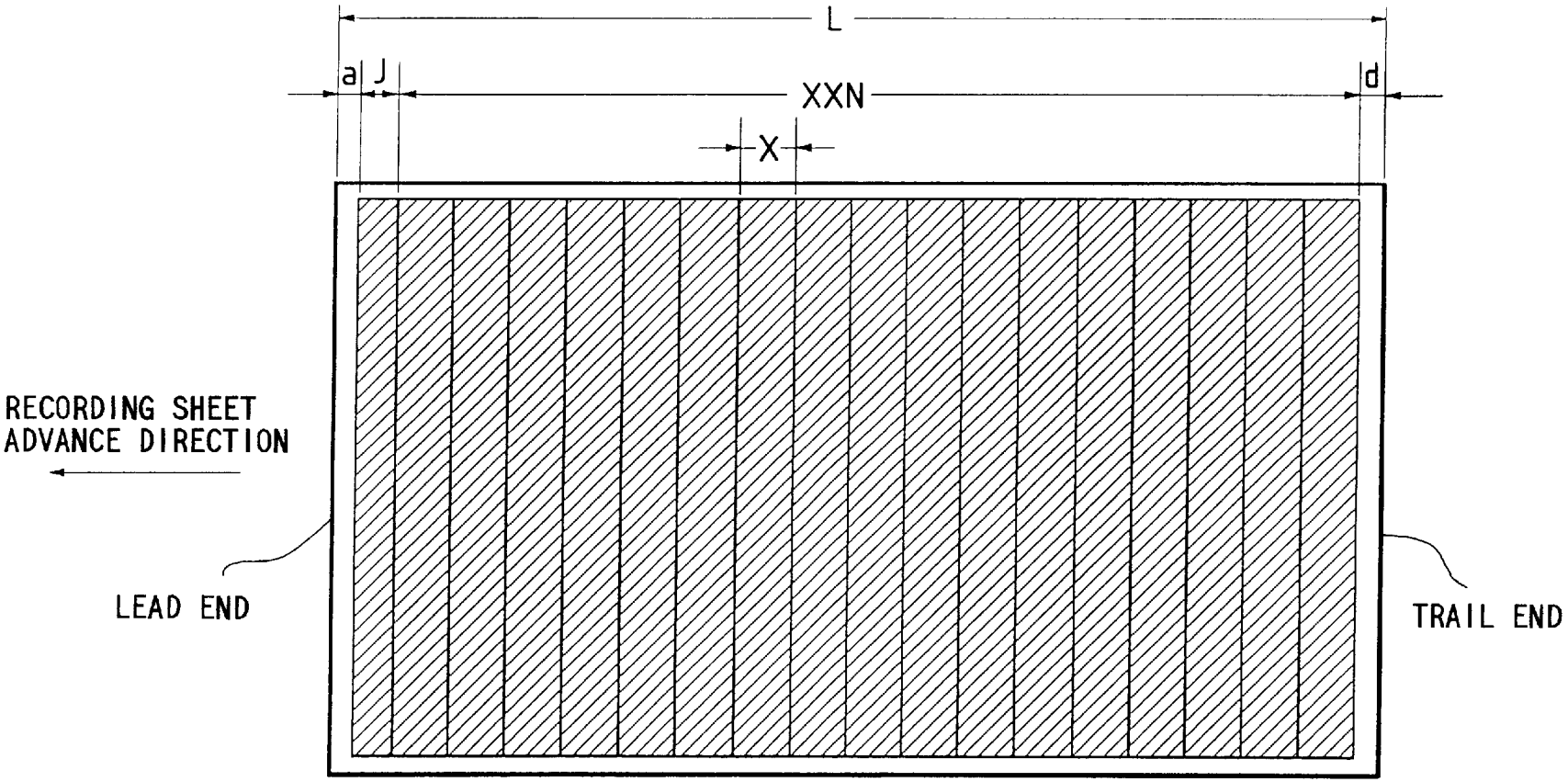
FIG. 5 is a plan view for explaining an image outputted from the image forming apparatus.

That is to say, after the lead end of the recording sheet 9 reaches the nip of the convey roller 1, when the sheet is advanced by an amount corresponding to the sum of the lead end margin a, the remaining recordable area J, the value obtained by multiplying the recording width X by the recording number N, and the trail end margin d, the recording sheet 9 leaves the nip of the convey roller 1. Such a relation is shown in FIG. 5. Here, a difference between the values d and b is equal to the difference between the values J1 and J. Namely, b−d=J−J1 [=0.02 mm]. This value is smaller than e/2 (about 32 μm). Accordingly, the trail end margin is changed within 32 μm at the most, which can be negligible.

Next, an image forming operation effected by using the recording apparatus according to the illustrated embodiment will be explained.

Figure 4:
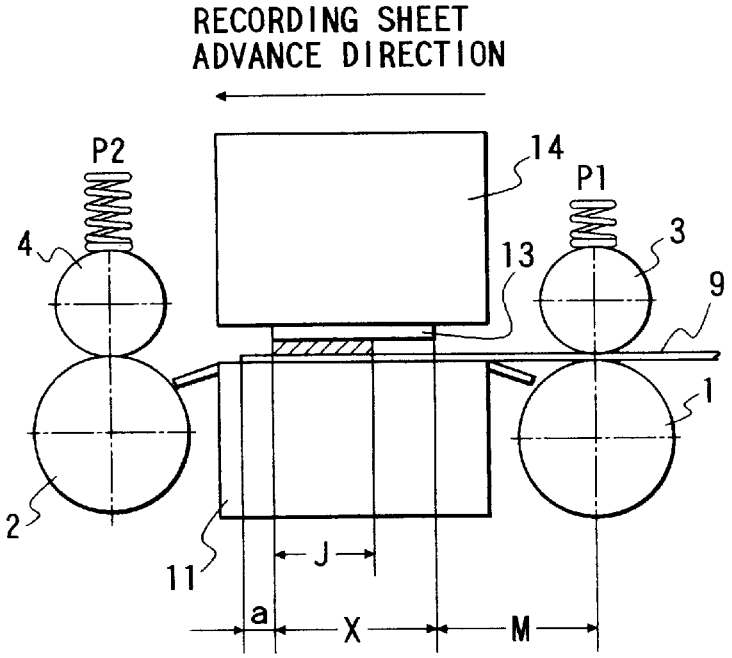
FIG. 4 is a view for explaining an operation of the recording portion of the image forming apparatus.

First of all, the recording sheet is supplied from one of cassettes 18 (FIG. 2) by means of a corresponding sheet supply device 19. When the recording sheet is further fed by intermediate rollers 12, the lead end of the recording sheet is detected by a sensor 10. From this point, the intermediate rollers 12 further feed the recording sheet by a predetermined amount. The lead end of the recording sheet reaches the nip of the convey roller 1, where a loop is formed in the recording sheet. At this point, the convey roller 1 starts to rotate, thereby conveying the recording sheet to an image formation starting position for the first line (i.e. by an amount of X+a+M [=36.256 mm]). This condition is shown in FIG. 4.

When the lead end of the recording sheet 9 reaches the first line image formation starting position, the carriage 14 (FIG. 1) on which the recording heads 13C to 13Bk is shifted on the guide rails 15*a*, 15*b*, thereby recording the first line of the image on the recording sheet. In this case, the recording is effected with the width J, and the number of nozzles at the downstream side is J/e [=168].

After the first line recording is finished, the recording sheet 9 is conveyed by means of the convey roller 1 by the distance J. In this case, the convey amount of the recording sheet 9 depends upon the convey roller 1 alone. Accordingly, the number of drive pulses corresponding to INT(J/0.008128+0.5) [=1313] are applied to the pulse motor 6.

At this point, the recording sheet 9 was conveyed by an amount of (X+a+M+J[=46.924 mm]) after the lead end of the recording sheet 9 reached the nip of the convey roller 1. Accordingly, a length of the recording sheet 9 remaining at the upstream side of the nip of the convey roller 1 becomes as follows:

$$L-(X+a+M+J)[=250.076\text{ mm}] \quad (7)$$

Since the recording regarding the width J was finished, from the next time, the recording is; repeated with the recording width X by the number of N to complete the recording of one page. In the repeated recording operations, the recording sheet is conveyed by the distance X each time.

Now, after (N−2)th recording is finished, a condition that (N−1)th [=16] recording with the recording width X is being effected is considered. In this condition, since the recordings with the recording width X were already effected by (N−2) [=15] times, the length c of the recording sheet 9 remaining at the upstream side of the nip of the convey roller 1 is reduced in comparison with the equation (7). Namely:

$$L-(X+a+M+J)-(N-2)\times X[=6.216\text{ mm}] \quad (8)$$

That is to say, when the recording regarding the width J is regarded as one recording, the length of the recording sheet 9 remaining at the upstream side of the nip of the convey roller 1 while the N-th recording is being effected has a value shown in the equation (8). Then, after the last conveyance of the sheet is performed, the trail end margin of the recording sheet on which the image was recorded becomes d [=4.98 mm]. Thereafter, the recording sheet 9 is discharged toward the downstream side by the discharge roller 2 and the associated driven roller 4. The above-mentioned operations are a recording method and a conveying method.

Next, a method for determining a diameter D2 of the discharge roller 2 required for eliminating the elongation of the sheet will be explained.

When the rate of elongation of the sheet regarding one recording width is k [=0.01], the elongation of the sheet regarding the recording width X becomes X×k [=0.16256 mm]. Accordingly, when the recording sheet 9 is pinched by the convey roller 1 while the conveyance of the sheet is being effected, the discharge roller 2 must convey the recording sheet by an amount of (X+Xk) or more during the convey roller 1 conveys the recording sheet by an amount of L1 (=X). That is to say, the convey amount L2 of the discharge roller 2 must be as follows: L2≧L1+t=X+Xk [=16.419 mm]. In this case, since the rollers 1, 2 are driven by the common motor to which the same number of pulses are applied, the diameter D2 of the discharge roller 2 is determined as D2≧15.679 mm.

However, when the conveyance is started from a position where the length of the recording sheet 9 remaining at the upstream side of the nip of the convey roller 1 is c, since the trail end of the recording sheet 9 leaves the nip of the convey roller 1 after the recording sheet is conveyed by the distance c, the elongation amount which is actually eliminated is smaller than the elongation amount of the sheet which is eliminated in the condition that the recording sheet is conveyed while it is being pinched by both of the rollers 1, 2.

Such an elongation amount is as follows:

$$X\times k\times(c/X)=0.16256\times(6.216/16.256)=0.06126\text{ mm.}$$

That is to say, the following elongation amount cannot be eliminated by the discharge roller 2 remains as it is:

$$X\times k-X\times k(c/X)=0.16256-0.06126=0.1013\text{ mm.}$$

This value is greater than the distance (0.0635 mm) between the adjacent nozzles, with the result that the recording width is overlapped with the next recording width, thereby generating a high density stripe.

To avoid this, a convey amount of the discharge roller 2 which can eliminate the elongation amount Xk of the sheet before the trail end of the recording sheet 9 leaves the nip of the convey roller 1 is sought.

When it is assumed that a convey amount of the convey roller 1 and a convey amount of the discharge roller 2 before the trail end of the recording sheet 9 leaves the nip of the convey roller 1 are $L_{1\text{-}1}$, $L_{2\text{-}1}$, respectively, the following relation must be satisfied:

$$L_{2\text{-}1}\geqq L_{1\text{-}1}+X\times k.$$

In case of $L_{2\text{-}1}=L_{1\text{-}1}+X\times k=c+X\times k$, when it is assumed that a convey amount of the discharge roller 2 after the trail end of the recording sheet 9 leaves the nip of the convey roller 1 is $L_{2\text{-}2}$, the following relation is obtained:

$$L_{2\text{-}2}=X-L_{1\text{-}1}.$$

A diameter D2 of the discharge roller which can satisfy the above relation may be determined.

In this regard, $$D2=(c+X\times k)/c\times D1=(6.216+0.16256)/6.216\times D1=15.929 \text{ mm}.$$

When it is assumed that convey amounts of the rollers 1, 2 for each pulse are L1P, L2P, respectively, the following relation is obtained:

$$L2P=D2/D1\times L1P=\{1+(X/c)\times k\}\times L1P.$$

In this case, the convey amount for each pulse becomes 0.00834 mm. Further, if the motor is driven by 2000 pulses as is in the previous conveyance, when the recording sheet is conveyed only by the discharge roller 2 having the greater convey amount, since a convey amount greater than the aimed or target convey amount is achieved, the number of drive pulses must be decreased during this conveyance.

The number of pulses consumed before the trail end of the recording sheet 9 leaves the nip of the convey roller 1 is c/L1P. Actually, such number is INT(6.216/0.008128+0.5)=765.

On the other hand, a convey amount of the sheet which is to be conveyed after the trail end of the recording sheet 9 leaves the nip of the convey roller 1 is X−c=16.256−6.216=10.04 mm. This amount corresponds to the number of pulses of (X−c)L2P. Actually, such number is INT(10.04/0.00834+0.5)=1204.

Thus, the total number N of pulses during this conveyance becomes as follows:

$$N=c/L1P+(X-c)L2P=765+1204=1969.$$

In this way, on the basis of D2=(c+Xk)/c+D1, when D1=15.523 mm, by setting the diameter D2 to 15.929 mm, the elongation of the sheet can be completely eliminated by the discharge roller 2 through the whole recording area before recording is started, thereby preventing the overlap between the adjacent recording widths to avoid the occurrence of the high density stripe. Further, the contact between the recording sheet and the recording head due to the floating of the sheet, and generation of wrinkles in the sheet can be prevented.

Incidentally, in this embodiment, the convey roller 1 and the discharge roller 2 may be driven by different pulse motors.

Next, a second embodiment of the present invention will be explained. A main construction of this embodiment will be described with reference to FIGS. 6 and 2. The convey roller 1 and the sheet discharge roller 2 are discrete pulse motors 6*a*, 6*b*, respectively. The pulse motors 6*a*, 6*b* are controlled by a CPU (control means) 17.

Main specification in the second embodiment is as follows:

| | |
|---|---|
| Number of teeth of pulley | 42 |
| Diameter of roller | 15.523 mm |
| Convey amount for each pulse | 8.128 $\mu$m |

These values are the same regarding both of the convey roller 1 and the discharge roller 2.

A biasing force of the driven roller 3 is 2.4 Kg and a biasing force of the driven roller 4 is 0.6 Kg. The recording method is the same as that in the first embodiment (refer to FIGS. 3, 4 and 5).

Now, a method for driving the rollers which is different from that in the first embodiment will be explained.

When the rate of elongation of the sheet regarding one recording width is k [=0.01], the elongation amount of the sheet regarding the recording width X becomes X×k [=0.16256 mm]. Accordingly, after the recording is finished and before the recording sheet is conveyed, such an elongation amount must be eliminated by the discharge roller 2.

To this end, by controlling the motors 6*a*, 6*b* by means of the CPU 17, the following series of driving operations are carried out:

(1) after the recording is finished, the convey roller 1 is stopped and the discharge roller 2 is driven in such a manner that the convey amount of this roller 2 becomes (X×k) or more (corresponding to 20 pulses or more);

(2) after the discharge roller 2 is stopped, the rollers 1, 2 are driven in such a manner that the convey amounts of these rollers become X (corresponding to 2000 pulses); and (3) after both rollers 1, 2 are stopped, the next recording is effected.

In this way, the elongation amount of the recording sheet can be eliminated by means of the discharge roller 2 before the next recording is started. Incidentally, since the motor for driving the convey roller 1 is maintained in an energized condition in the above operation (1) and the biasing force of the driven roller 3 is greater than that of the driven roller 4 by four times, a position of the nip of the convey roller 1 is not displaced even when the discharge roller 2 alone is driven.

In this way, the elongation of the sheet can be completely eliminated by the discharge roller 2 through the whole recording area before recording is started, thereby preventing the overlap between the adjacent recording widths to avoid the occurrence of the high density stripe. Further, the contact between the recording sheet and the recording head due to the floating of the sheet, and generation of wrinkles in the sheet can be prevented.

Figure 6:
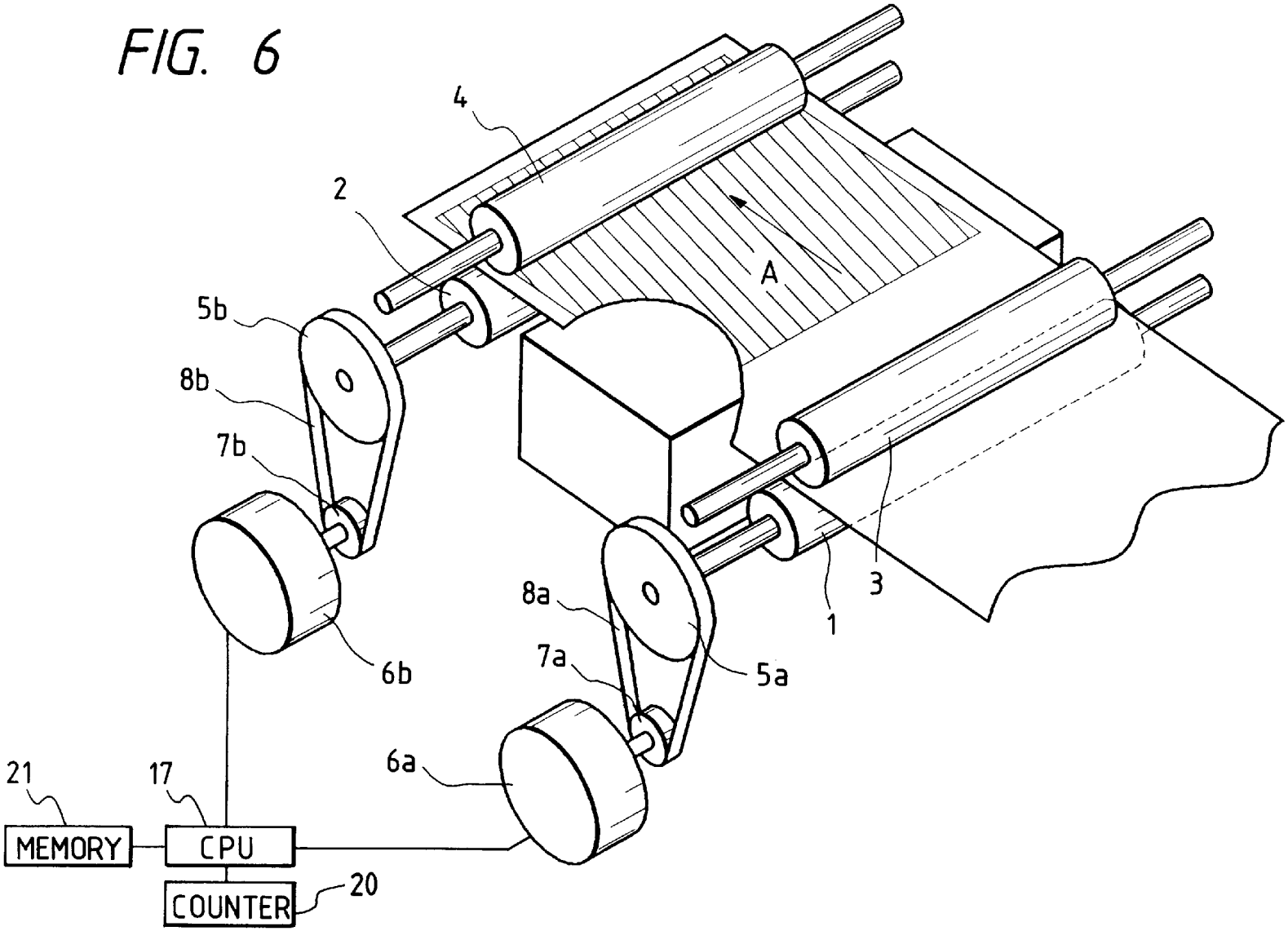
FIG. 6 is a perspective view of a recording portion of an image forming apparatus according to a second embodiment of the present invention.

Next, a third embodiment of the present invention will be explained. Since a main construction of this third embodiment is the same as that of the above-mentioned second embodiment, FIGS. 6 and 2 are also referred to. The convey roller 1 and the sheet discharge roller 2 are discrete pulse motors 6*a*, 6*b*, respectively. The pulse motors 6*a*, 6*b* are controlled by a CPU (control means) 17.

Main specification in the third embodiment is as follows:

| | |
|---|---|
| Number of teeth of pulley | 42 |
| Diameter of roller | 15.523 mm |
| Convey amount for each pulse | 8.128 $\mu$m |
| Pulse number supplied for each conveyance | 2000 |

These values are the same regarding both of the convey roller 1 and the discharge roller 2.

A biasing force of the driven roller 3 is 2.4 Kg and a biasing force of the driven roller 4 is 0.6 Kg.

When the recording is performed by using the apparatus according to the third embodiment, the lead end margin of a and the trail end margin of b are generated regardless of the size of the recording sheet.

Figure 7:
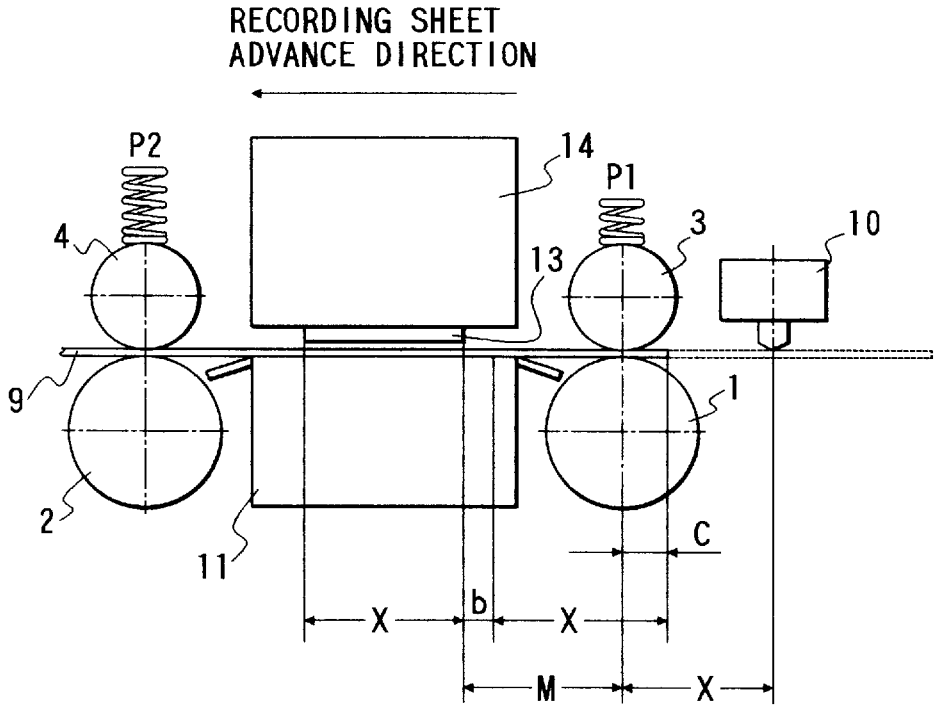
FIG. 7 is a view showing a positional condition of an image forming apparatus according to a third embodiment of the present invention.

FIG. 7 shows a dimensional relation between main elements of the apparatus according to the third embodiment in a sectional plane. As shown in FIG. 7, a distance between the nip of the convey roller 1 and an upstream end of the recording area is set to a value M. Further, when the trail end of the recording sheet 9 can leave the nip of the convey roller 1 during the next conveyance, it is assumed that a distance between the trail end of the recording sheet 9 and the nip of the convey roller 1 is c.

In the third embodiment, the recording sheet detection sensor 10 is disposed at an upstream side of the nip between the rollers 1, 3 and spaced apart from such nip by a distance X. Incidentally, the concrete values in the third embodiment are as follows:

$X$=16.256 mm, $a$=5 mm, $b$=5 mm, and $M$=11 mm.

Further, a distance e between the adjacent nozzles is 0.0635 mm.

Next, an image forming operation effected by using the recording apparatus according to the third embodiment will be explained.

Figure 8:
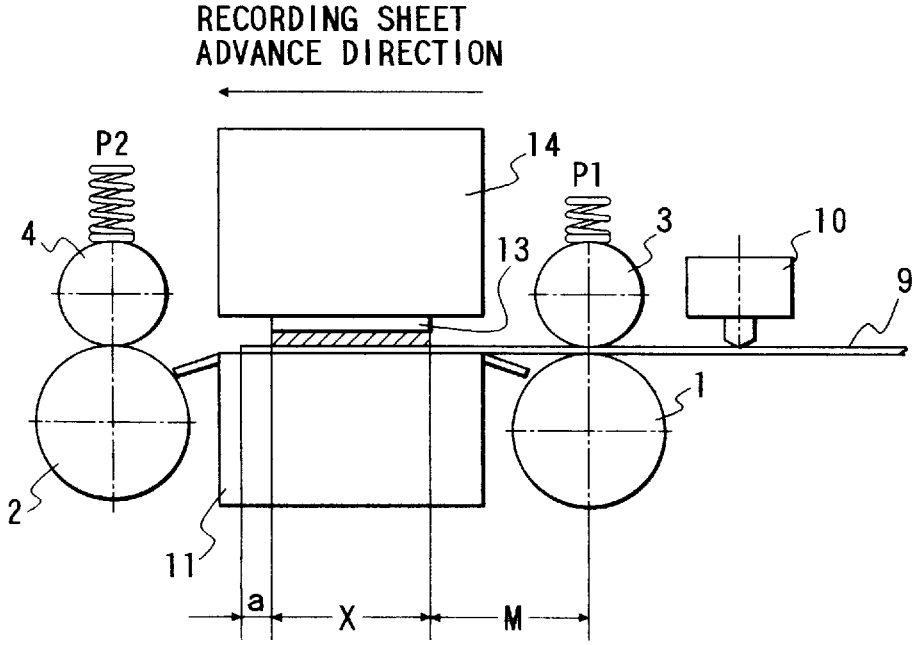
FIG. 8 is a view for explaining an operation of the recording portion of the image forming apparatus of FIG. 7.
Figure 9:
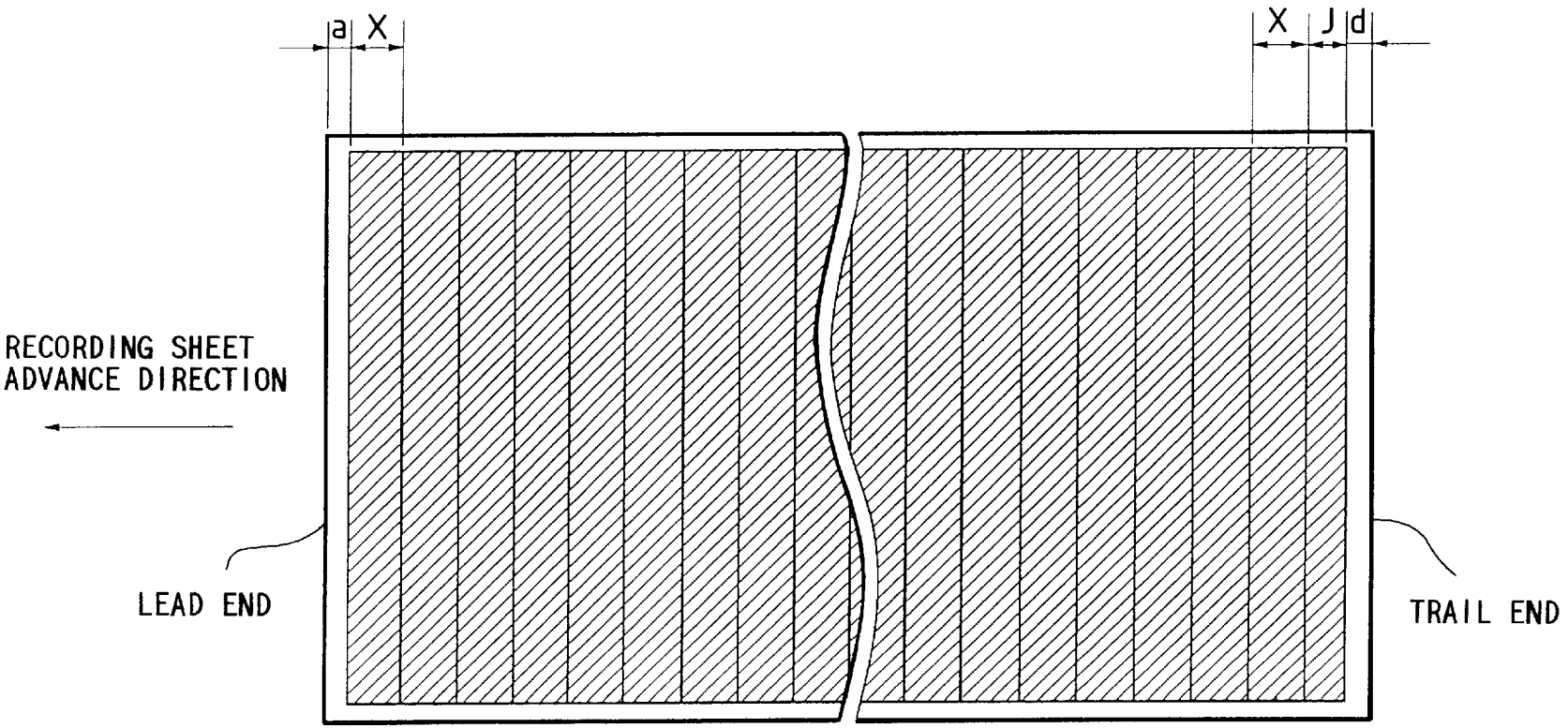
FIG. 9 is a plan view for explaining an image outputted from the image forming apparatus of FIG. 7.

First of all, the recording sheet is supplied from one of the cassettes 18 by means of the corresponding sheet supply device 19. When the recording sheet is further fed by intermediate rollers 12, the lead end of the recording sheet reaches the recording sheet detection sensor 10. From this point, the intermediate rollers 12 further feed the recording sheet by a an amount exceeding the distance X. The lead end of the recording sheet reaches the nip of the convey roller 1 which is not stopped, where a loop is formed in the recording sheet. At this point, the convey roller 1 starts to rotate, thereby conveying the recording sheet to an image formation starting position for the first line (i.e. by an amount of X+a+M [=32.256 mm]). This condition is shown in FIG. 8.

When the lead end of the recording sheet 9 reaches the first line image formation starting position, the first line of the image is recorded on the recording sheet by means of the recording heads 13C–13Bk. In this case, the recording width is X, after the recording is finished, the recording sheet is conveyed by the distance X. At this point, the convey amount only depends upon the convey roller 1 alone, the number of drive pulses is 2000.

After the first line recording is finished, when the recording with the recording width X and the conveyance with the distance X are repeated, the recording sheet detection sensor 10 detects the trail end of the recording sheet 9 during the conveyance of the sheet after a certain number of recording operations were finished.

Incidentally, in the third embodiment, the number of pulses supplied to the motor from the start of the conveyance of the recording sheet 9 is counted by a counter 20 each time, and the counter is stopped when the trail end of the recording sheet 9 is detected by the recording sheet detection sensor 10. When the trail end of the recording sheet 9 is detected by the recording sheet detection sensor 10, the number of pulses counted by the counter is stored in a memory 21. The recording sheet 9 is further conveyed, and, when the convey amount reaches X, the conveyance is stopped and the recording is effected with the recording width X. Incidentally, the memory and/or the counter may be incorporated into the CPU.

When it is assumed that the pulse number stored in the memory is Z, a distance through which the recording sheet is conveyed after the trail end of the recording sheet 9 passes through the recording sheet detection sensor 10 becomes X−Z×8.128/1000.

That is to say, in this condition, the trail end of the recording sheet is positioned at the upstream side of the nip of the convey roller 1 and is spaced apart from the nip by the distance c{=X−(X−Z×8.128/1000)}.

Next, a conveying method when the trail end of the recording sheet is passed through the nip of the convey roller 1 will be explained.

When the rate of elongation of the sheet regarding one recording width is k [=0.01], the elongation amount of the sheet regarding the recording width X becomes X×k [=0.16256 mm]. Accordingly, after the recording is finished and before the recording sheet is conveyed, such an elongation amount must be eliminated by the discharge roller 2. That is to say, while the recording sheet is being conveyed by the distance c by means of the convey roller 1, the recording sheet must be conveyed by the distance (c+X×k) or more by means of the discharge roller 2. In this case, since the diameter of the convey roller is the same as that of the discharge roller and these rollers are driven simultaneously, the driving frequency of the motor for driving the discharge roller 2 is made greater than that of the motor for driving the convey roller 1, thereby increasing the convey speed V2 of the discharge roller 2. When the convey speed of the convey roller 1 is V1, the convey speed V2 is set to satisfy the following relation:

$$V2 \geqq (c+Xk)/c \times V1 = \{1+(X/c)\times k\} \times V1$$

After the trail end of the recording sheet 9 leaves the nip of the convey roller 1, so long as the pulse number supplied to the motor associated with the discharge roller is 2000 during this conveyance, the convey speed of the discharge roller 2 can be maintained to V2.

A convey time T2 of the discharge roller 2 becomes as follows:

$$T2 = c/V1 + (X-c)/V2$$

Further, the above-mentioned setting is effective to be adopted to the previous conveying operations, as well as the this conveying operation.

The CPU 17 serves to calculate the values V2, T2 on the basis of the above relations and control the pulse motors 6*a*, 6*b* on the basis of the calculated result.

After this conveyance is finished, the next recording width can be determined on the basis of the size of the recording sheet detected by a detection means (not shown) disposed in the cassette 18 or the operator's input, and the lead and trail end margins a, b.

That is to say, the following values can be determined:

Recording area=L−(a+b)

Number J in which the recording can be effected with the recording width $$J = INT\{(L-(a+b))/16.256\}$$

Recording area (last recording) to be recorded with the recording width smaller than X=L−(a+b)−J×16.256

In this way, the elongation of the sheet can be eliminated by the discharge roller through the whole recording area before the recording is started, thereby preventing the overlap between the adjacent recording width to avoid the occurrence of the high density stripe. Further, the contact between the recording sheet and the recording head due to the floating of the sheet, and generation of wrinkles in the sheet can be prevented.

That is to say, (1) the deterioration of the image quality and the poor conveyance due to the elongation of the recording sheet can be prevented;

(2) when the trail end of the recording sheet leaves the nip of the upstream roller, the conveying accuracy and the recording accuracy are not worsened, thereby obtaining the image having no stripes; and (3) the above conveying accuracy and recording accuracy are not influenced upon the size of the recording sheet, and an image forming apparatus which can be applied to recording sheet having non-fixed sizes.

As mentioned above, according to the present invention, it is possible to prevent the looseness and the floating of the recording sheet and the sheet jam due to the elongation of the recording sheet generated between the first and second convey means, thereby preventing the occurrence of the high density stripe when the image is formed by the image forming apparatus.

Figure 10:
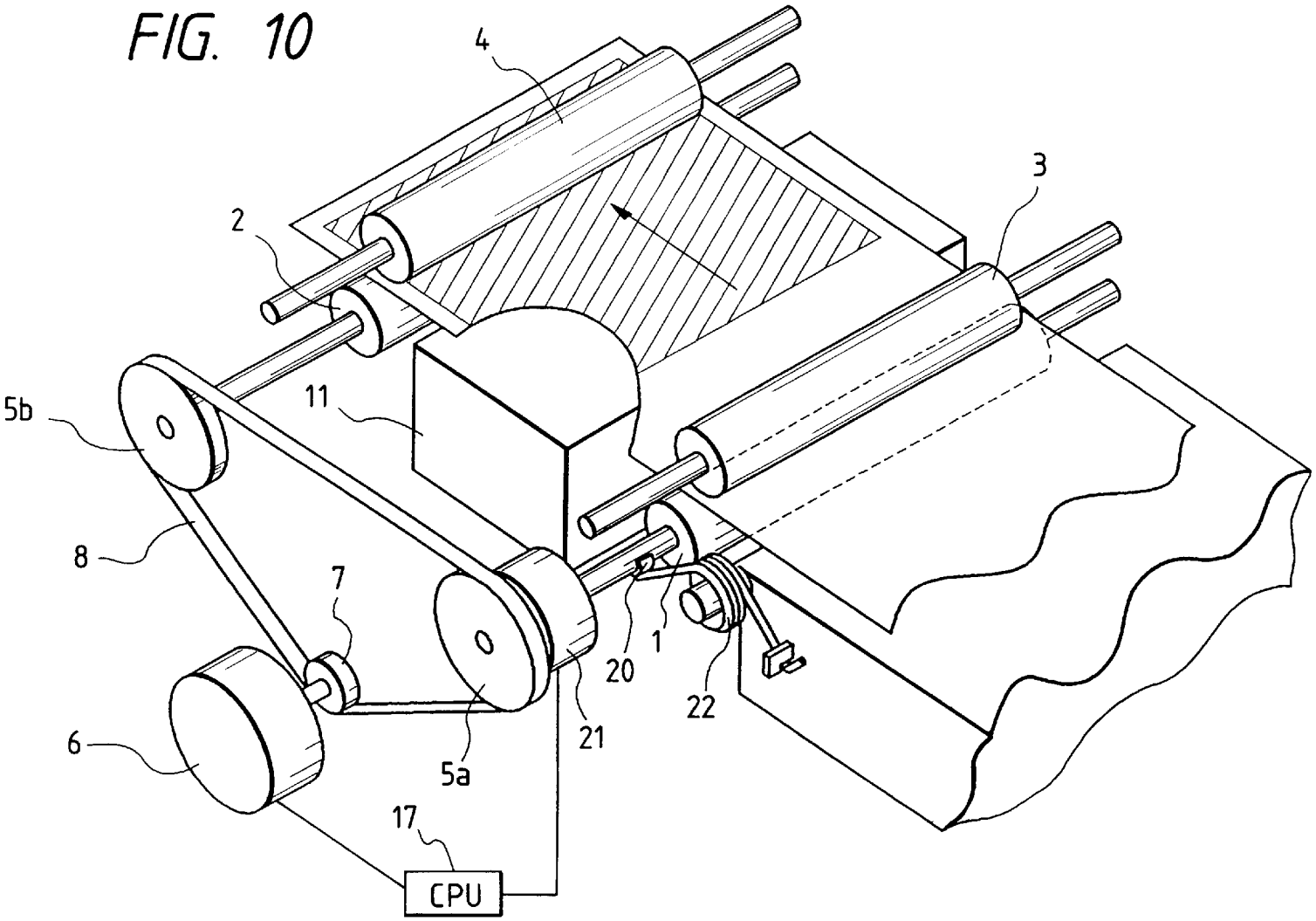
FIG. 10 is a perspective view of a recording portion of an image forming apparatus according to a fourth embodiment of the present invention.
Figure 11:
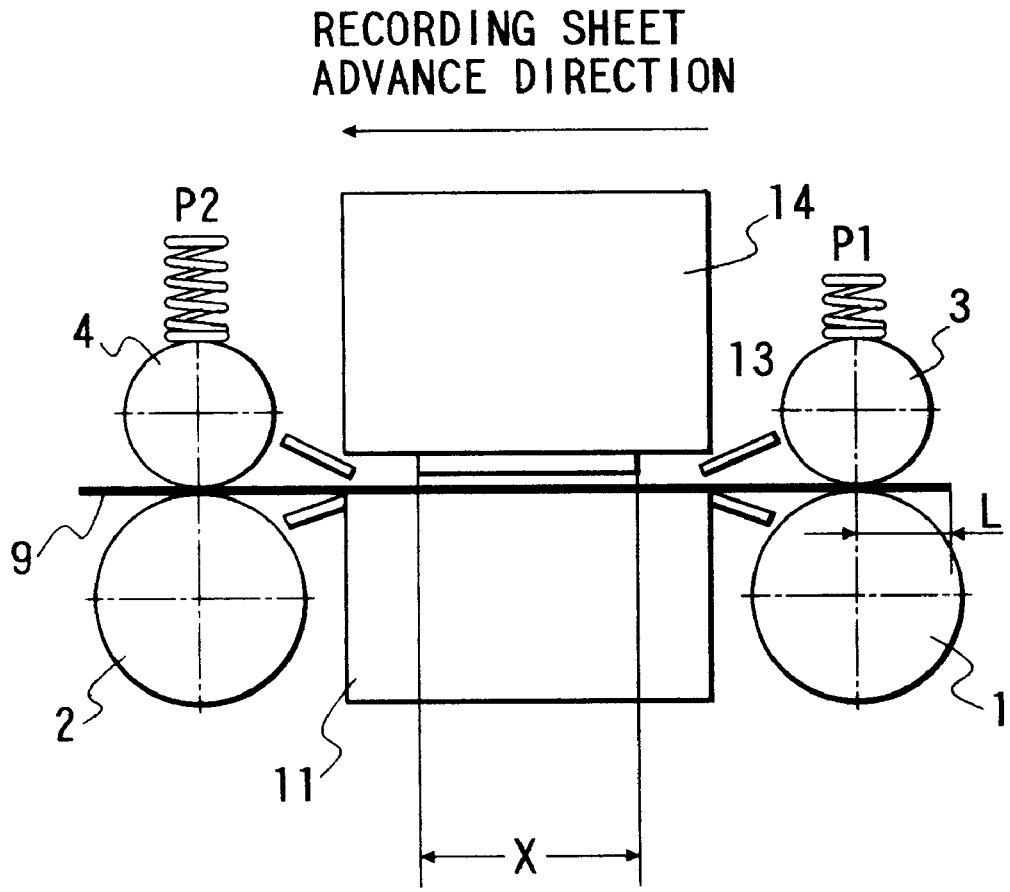
FIG. 11 is a sectional view of a recording portion of a conventional image forming apparatus.

Next, a fourth embodiment of the present invention will be explained with reference to FIGS. 10 and 2. In this case, the convey roller 1 and the sheet discharge roller 2 are driven by a common pulse motor 6. The convey roller 1 is connected to a pulley 5*a* through an electromagnetic clutch 21. Accordingly, when the electromagnetic clutch 21 is turned ON or OFF, the convey roller is operated or stopped. Further, a pad 20 is urged against the shaft of the convey roller 1 by means of a spring 22, thereby increasing the stop torque for the convey roller 1. The pulse motor 6 and the electromagnetic clutch 21 are controlled by the CPU 17.

Main specification in the fourth embodiment is as follows:

| | |
|---|---|
| Number of teeth of pulley | 42 |
| Diameter of roller | 15.523 mm |
| Convey amount for each pulse | 8.128 $\mu$m |

These values are the same regarding both of the convey roller 1 and the discharge roller 2.

A biasing force of the driven roller 3 is 2.4 Kg and a biasing force of the driven roller 4 is 0.6 Kg. The recording method is the same as that in the above-mentioned embodiments (refer to FIGS. 3, 4 and 5).

Now, a method for driving the rollers which is different from that in the above-mentioned embodiments will be explained.

When the rate of elongation of the sheet regarding one recording width is k [=0.01], the elongation amount of the sheet regarding the recording width X becomes X×k [=0.16256 mm]. Accordingly, after the recording is finished and before the recordirg sheet is conveyed, such an elongation amount must be eliminated by the discharge roller 2.

To this end, by controlling the pulse motor 6 and the electromagnetic clutch 21 by means of the CPU 17, the following series of driving operations are carried out:

(1) First of all, the electromagnetic clutch 21 is turned ON to drive the convey roller 1, thereby conveying the recording sheet to the predetermined position.

(2) After the recording is finished, the electromagnetic clutch 21 is turned OFF to step the convey roller 1, and the discharge roller 2 is driven to convey the recording sheet by the distance of (X×k) or more (corresponding to the pulse number of 20 or more).

(3) After the discharge roller 2 is stopped, the electromagnetic clutch 21 is turned ON to drive the convey roller 1 by the distance of X (corresponding to the pulse number of 2000).

(4) After the rollers 1, 2 are stopped, the recording is effected.

In this way, the elongation of the sheet can be completely eliminated by the discharge roller 2 through the whole recording area before recording is started. Incidentally, in the above driving operation (2), since the pad 20 is urged against the shaft of the convey roller 1 through the spring 22 to increase the stop torque for the convey roller 1, even when the discharge roller 2 alone is driven, the recording sheet is not moved.

Thus, the elongation of the sheet can be completely eliminated by the discharge roller 2 through the whole recording area before recording is; started, thereby preventing the overlap between the adjacent recording widths to avoid the occurrence of the high density stripe. Further, the contact between the recording sheet and the recording head due to the floating of the sheet, and generation of wrinkles in the sheet can be prevented.

What is claimed is:

1. A sheet convey apparatus comprising:

a first convey means for pinching and conveying a sheet; and a second convey means disposed at a downstream side of said first convey means and adapted to pinch and convey the sheet;

wherein when an elongation of the sheet generated between said first and second convey means is t, a convey amount of said first convey means is L1 and a convey amount of said second convey means is L2, a relation of L2≧L1+t is satisfied.

2. A sheet convey apparatus according to claim 1, wherein, when a trail end of the sheet leaves said first convey means as it is conveyed, said second convey means conveys the sheet a distance greater than said first convey means by an amount t until the trail end of the sheet leaves said first convey means from a start of conveyance.

3. An image forming apparatus comprising:

a first convey means for pinching and conveying a sheet;

a second convey means disposed at a downstream side of said first convey means and adapted to pinch and convey the sheet; and an image forming means disposed between said first convey means and said second convey means and adapted to form an image having a length x in a sheet conveying direction;

wherein a formation of the image having length X in the sheet conveying direction and conveyance of the sheet are alternately performed; and when a rate of elongation of the sheet caused by image forming by said image forming means is k, while the conveyance by which a trail end of the sheet leaves a nip of said first convey means is being effected, said first convey means and said second convey means are driven simultaneously to satisfy a relation of $L_{2\text{-}1} \geqq L_{1\text{-}1}+X\times k$, where $L_{1\text{-}1}$ and $L_{2\text{-}1}$ are sheet convey amounts by said first convey means and said second convey means before a trail end of the sheet leaves the nip of said first convey means, respectively.

4. An image forming apparatus according to claim 3, wherein, during the conveyance by which the trail end of the sheet leaves the nip of said first convey means, a relation of $L_{2\text{-}2}=X-L_{1\text{-}1}$ is satisfied, where $L_{2\text{-}2}$ is a convey amount of said second convey means after the trail end of the sheet leaves the nip of said first convey means.

5. An image forming apparatus according to claim 4, wherein said first and second convey means comprise rotary members for conveying the sheet, and discrete stepping motors for driving said rotary members.

6. An image forming apparatus according to claim 3, wherein, during the conveyance by which the trail end of the sheet leaves the nip of said first convey means, a relation of $V2 \geqq \{1+(X/c)\times k\}\times V1$, where c is distance between the nip of said first convey means and trail end of the sheet, and V1 and V2 are convey speeds of said first and second convey means.

7. An image forming apparatus according to claim 6, wherein a relation of $T2=c/V1+(X-c)/V2$ is satisfied, where T2 is a driving time of said second convey means during the conveyance by which the trail end of the sheet leaves the nip of said first convey means.

8. An image forming apparatus according to claim 6, further comprising a means for measuring the value c, and a controller for changing driving frequency supplied to said stepping motors in accordance with the measured value.

9. An image forming apparatus according to claim 3, wherein said first and second convey means are driven by a common stepping motor.

10. An image forming apparatus according to claim 9, wherein, during he sheet conveyance by which the trail end of the sheet leaves the nip of said first convey means, sheet convey amounts by said first convey means and said second convey means satisfy a relation of $L2P \geqq \{1+(X/c)\times k\}\times L1P$, where c is distance between the nip of said first convey means and trail end of sheet, L1P is a convey amount by said first convey means per one pulse, and L2P is a convey amount by said second convey means per one pulse.

11. An image forming apparatus according to claim 10, wherein a drive pulse number N during the conveyance by which the trail end of the sheet leaves the nip of said first convey means satisfies a relation of $N=c/L1P+(X-c)/L2P$.

12. An image forming apparatus comprising a pair of rollers disposed at an upstream side of a recording portion, and a pair of rollers disposed at a downstream side of said recording portion, a recording sheet being intermittently conveyed by one or both of said roller pairs to form an image on the recording sheet, wherein when a recording width at said recording portion is X and a rate of elongation of the recording sheet caused by image forming by an image forming means is k, during sheet conveyance by which a trail end of the recording sheet leaves a nip of said upstream roller pair, said roller pair are driven in such a manner that at first the sheet convey amount by said upstream roller pair becomes zero (stop) and the sheet convey amount by said downstream roller pair becomes greater than (X×k) and thereafter the sheet convey amount by said upstream roller pair becomes X and the sheet convey amount by said downstream roller pair becomes X.

13. An image forming apparatus according to claim 12, wherein said upstream and downstream roller pairs are driven by discrete stepping motors.

14. An image forming apparatus according to claim 13, wherein said upstream and downstream roller pairs are driven by a common stepping motor, and further comprising means for independently changing the convey amounts and convey speeds of said upstream and downstream roller pairs.

15. An image forming apparatus according to claim 12 or 14, wherein, during, each conveyance prior to the conveyance by which the trail end of the recording sheet leaves the nip of said upstream roller pair, said roller pairs are driven in such a manner that a convey amount of said upstream roller pair becomes zero (stop) and a convey amount of said downstream roller pair becomes greater than (X×k) and thereafter the convey amount of said upstream roller pair becomes X and the convey amount of said downstream roller pair becomes X.

16. An image forming apparatus according to claim 3 or 12, wherein, when recording holding forces of said upstream and downstream roller pairs are P1 and P2, respectively, a relation of P1>P2 is satisfied.

17. An image forming apparatus according to claim 3 or 12, wherein, when recording pinching pressures of said upstream and downstream roller pairs are P1 and P2, respectively, a relation of P1>P2 is satisfied.

18. An image forming apparatus according to claim 3 or 12, wherein, when friction forces between said upstream and downstream roller pairs and the recording sheet are P1 and P2, respectively, a relation of P1>P2 is satisfied.

19. An image forming apparatus comprising:

an image forming means disposed between said first and second convey means and adapted to form an image having a length X in a sheet conveying direction; and said sheet conveying apparatus according to claim 1 or 2.

20. An image forming apparatus according to any one of claims 3 to 19, wherein said image forming means forms the image by discharging an ink droplet.

21. An image forming apparatus according to claim 20, wherein said image forming means forms the image by discharging the ink droplet by utilizing thermal energy.

22. An image forming apparatus comprising:

a first convey member for conveying a sheet;

a second convey member disposed at a downstream side of said first convey member and adapted to convey the sheet; and an image forming means disposed between said first and second convey means and adapted to form an image having a length of X in a sheet conveying direction;

wherein after the image having the length of X in the sheet conveying direction is formed by said image forming means, said first convey member conveys the sheet by a convey distance corresponding to said length X and said second convey member conveys the sheet by a convey distance greater than the convey distance of said first convey member so that the sheet is conveyed by said convey distance X while said second convey member is being slipped with respect to the sheet;

wherein said second convey member performs conveyance sufficient to eliminate looseness generated in the sheet between said first and second convey members by image formation of said image forming means.

23. An image forming apparatus comprising:

a first convey member for conveying a sheet;

a second convey member disposed at a downstream side of said first convey member and adapted to convey the sheet; and an image forming means disposed between said first and second convey member and adapted to form an image having a length of X in a sheet conveying direction;

wherein after the image having the length of X in the sheet conveying direction is formed by said image forming means, said first convey member conveys the sheet by a convey distance corresponding to said length X and said second convey member conveys the sheet by a convey distance greater than the convey distance of said first convey member so that the sheet is conveyed by said convey distance X while said second convey member is being slipped with respect to the sheet;

wherein, when the sheet passes through said first convey member on the way that the sheet is being conveyed by said convey distance X, before the sheet passes through said first convey member, said second convey member performs conveyance sufficient to eliminate looseness generated in the sheet between said first and second convey members by image formation of said image forming means.

24. An image forming apparatus according to claim 23, wherein said second convey member performs the conveyance for eliminating the looseness of the sheet while said first convey member is stopped.

25. An image forming apparatus according to claim 24, wherein while second convey member is performing the conveyance for eliminating the looseness of the sheet, said first convey member is braked.

26. An image forming apparatus according to claim 23, further comprising:

a sensor for detecting passage of the sheet through a predetermined position; and a calculating means for calculating a convey distance c until the sheet passes through said first convey member on the basis of detection of said sensor and for calculating a convey speed and a convey time of said second convey member on the basis of the calculated convey distance c.

27. An image forming apparatus according to claim 26, further comprising a control means for controlling said second convey member on the basis of detection of the convey speed and the convey time of said second convey member calculated by said calculating means.

28. An image forming apparatus according to any one of claims 23 to 27, wherein said image forming means forms the image by discharging an ink droplet.

29. An image forming apparatus according to claim 28, wherein said image forming means forms the image by discharging the ink droplet by utilizing thermal energy.

30. An image forming apparatus comprising:

a first convey member for conveying a sheet;

a second convey member disposed at a downstream side of said first convey member and adapted to convey the sheet; and an image forming means disposed between said first and second convey member and adapted to form an image having a length X in a sheet conveying direction;

wherein after the image having the length of X in the sheet conveying direction is formed by said image forming means, said first convey member conveys the sheet by a convey distance corresponding to said length X and said second convey member conveys the sheet by a convey distance greater than the convey distance of said first convey member so that the sheet is conveyed by said convey distance X while said second convey member is being slipped with respect to the sheet;

wherein, when the sheet through said first convey member on the way that the sheet is being conveyed by said convey distance X, before the sheet passes through said first convey member, said second convey member performs conveyance to eliminate looseness generated in the sheet between said first and second convey members by image formation of said image forming means in a condition that said first convey member is stopped.

* * * * *

UNITED STATES PATENT AND TRADEMARK OFFICE

CERTIFICATE OF CORRECTION

PATENT NO. : 5,910,811

DATED : June 8, 1999

INVENTOR(S) : OSAMU SATO

It is certified that error appears in the above-identified patent and that said Letters Patent is hereby corrected as shown below:

COLUMN 2,
Line 35, "-trials" should read --trials--.
COLUMN 5,
Line 50, "ends" should read --end--.
COLUMN 6,
Line 56, "are" should read --area--.
COLUMN 7,
Line 33, "is" should read --are--.
COLUMN 13,
Line 36,"recordirg" should read --recording--.
COLUMN 15,
Line 9, "he" should read --the--.

Signed and Sealed this

Eighteenth Day of January, 2000

*Attest:*

Q. TODD DICKINSON

*Attesting Officer*

*Commissioner of Patents and Trademarks*